US011440709B2

(12) United States Patent
Lei

(10) Patent No.: US 11,440,709 B2
(45) Date of Patent: Sep. 13, 2022

(54) CONTAINER WITH SECURITY LOCK

(71) Applicant: Jing Lei, Guangdong (CN)

(72) Inventor: Jing Lei, Guangdong (CN)

(73) Assignee: DONGGUAN LK TIN PACKAGING CO., LTD., Dongguan (CN)

( * ) Notice: Subject to any disclaimer, the term of this patent is extended or adjusted under 35 U.S.C. 154(b) by 130 days.

(21) Appl. No.: 17/156,578

(22) Filed: Jan. 24, 2021

(65) Prior Publication Data

US 2021/0323736 A1 Oct. 21, 2021

Related U.S. Application Data

(60) Provisional application No. 63/012,828, filed on Apr. 20, 2020.

(51) Int. Cl.
*B65D 50/06* (2006.01)

(52) U.S. Cl.
CPC ..... *B65D 50/062* (2013.01); *B65D 2215/04* (2013.01); *B65D 2255/20* (2013.01)

(58) Field of Classification Search
CPC .. B65D 83/0418; B65D 83/04; B65D 45/322; B65D 50/062; B65D 50/061; B65D 50/06; B65D 41/04; B65D 41/0471; A61J 1/03
USPC ..... 215/272, 228, 337, 331, 330, 329, 223, 215/221, 218, 217, 216; 220/230, 298, 220/293, 288, 212; 206/535, 528
See application file for complete search history.

(56) References Cited

U.S. PATENT DOCUMENTS 2,860,802 A * 11/1958 Gold ..... B65D 45/322 215/272
5,317,796 A * 6/1994 Hunter ..... B65D 50/061 29/434
5,678,712 A * 10/1997 Rios ..... B65D 50/041 215/230
5,791,504 A * 8/1998 Hofmann ..... B65D 50/062 215/223
5,944,212 A * 8/1999 Chang ..... B65D 81/2038 220/DIG. 16
8,931,657 B2 * 1/2015 Kientzle ..... B65D 21/0233 220/345.3
9,187,220 B2 * 11/2015 Biesecker ..... B65D 43/0212
9,481,496 B2 * 11/2016 Cottle ..... B65D 50/046
2010/0038279 A1 * 2/2010 Estep ..... G09F 23/00 283/67
2020/0140156 A1 * 5/2020 Combs ..... B65D 50/061

FOREIGN PATENT DOCUMENTS

CA 2799542 A1 * 11/2011 ..... A61J 7/04
WO WO-9747528 A1 * 12/1997 ..... B65D 41/3419
WO WO-2008089306 A2 * 7/2008 ..... B65D 83/0409

* cited by examiner

*Primary Examiner* — Robert J Hicks
(74) *Attorney, Agent, or Firm* — Justin Lampel

(57) ABSTRACT

A container with a security lock is provided. The container may have a lid (or "top") portion and a bottom portion. The lid portion may be comprised of an exterior cover and a bottom ring acting as a single unit. Once inward protrusions on the exterior cover vertically aligns with indentation spaces on the bottom ring of the lid, a specific pressing and then twisting motion may be used to separate the lid from the bottom portion to gain access to the interior of the container. The bottom portion may receive contents such as medication.

13 Claims, 3 Drawing Sheets

CONTAINER WITH SECURITY LOCK

REFERENCE TO RELATED APPLICATIONS

This application claims priority to U.S. Provisional Application No. 63/012,828 which was filed on Apr. 20, 2020, the entire contents of which are incorporated by reference herein.

BACKGROUND OF THE INVENTION

A container with a security lock is provided. The container may have a lid (or "top") portion and a bottom portion. The lid portion may be comprised of an exterior cover and a bottom ring acting as a single unit. Once inward protrusions on the exterior cover vertically aligns with indentation spaces on the bottom ring of the lid, a specific pressing and then twisting motion may be used to separate the lid from the bottom portion to gain access to the interior of the container. The bottom portion may receive contents such as medication which may be securely stored and protected from children who might otherwise access an unprotected and unsecured container.

Containers with security locks are known. For example, U.S. Pat. No. 9,481,496 to Cottle discloses a child resistant container for nicotine products. The container comprises latching elements adapted to interlock with cooperating latching elements when said lid is pushed onto a said base to retain said lid to said base. The latching elements are further adapted to disengage from said cooperating latching elements when a simultaneous force is exerted on all releasable latching arrangements by two hands of a user or the like.

Further, U.S. Pat. No. 9,187,220 to Biesecker discloses a cap having a top wall, an outer peripheral edge, a first section, and a second section. A skirt depends from the outer peripheral edge. The skirt includes an attached end, a free end, a plurality of slots, and a plurality of apertures. Each aperture is spaced-apart from the free end of the skirt. The top wall has a first configuration and a second configuration. When the top wall is in the first configuration, the first section is generally planer and the second section is generally arcuate. When the top wall is in the first configuration, the skirt extends generally perpendicularly to the first section to generally engage at least a portion of a container. When the top wall is in the second configuration, the free end of the skirt extends radially outwardly from the attached end thereof to allow the cap to be removed from the container.

Still further, U.S. Pat. No. 8,931,657 to Kientzle discloses a pharmaceutical container having a bottle having a bottom wall and side walls. A ridge proximate to the bottom wall projects from an interior surface of at least one of the side walls, to facilitate nested stacking of a plurality of bottles. One or more of the side walls includes a cover locking receptacle proximate to the top end of the side wall. The pharmaceutical container also includes a cover including a sliding lid contained in a cover housing. The cover housing has a top wall, which includes an opening, and cover side walls. A child-resistant closure mechanism is also provided to limit the movement between the sliding lid and the bottle.

However, these patents fail to describe a container with a security lock which is easy to use. Further, these patents fail to provide for a container with a security lock which allows a user to unlock a child-resistant container in a simple and safe manner.

SUMMARY OF THE INVENTION

A container with a security lock is provided. The container may have a lid (or "top") portion and a bottom portion. The lid portion may be comprised of an exterior cover and a bottom ring acting as a single unit. Once inward protrusions on the exterior cover vertically aligns with indentation spaces on the bottom ring of the lid, a specific pressing and then twisting motion may be used to separate the lid from the bottom portion to gain access to the interior of the container. The bottom portion may receive contents such as medication which may be securely stored and protected from children who might otherwise access an unprotected and unsecured container.

An advantage of the present child resistant storage container is that the present child resistant storage container is suitable for seniors which typically have difficulty opening typical child resistant containers.

And another advantage of the present child resistant storage container is that the present container keeps the contents of the container secure and dry in a moisture-resistant manner.

Still another advantage of the present child resistant storage container is that the present container lacks exterior sharp edges and corners which may otherwise injure someone.

For a more complete understanding of the above listed features and advantages of the container with a security lock reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A container with a security lock is provided. The container may have a lid (or "top") portion and a bottom portion. The lid portion may be comprised of an exterior cover and a bottom ring acting as a single unit. Once inward protrusions on the exterior cover vertically aligns with indentation spaces on the bottom ring of the lid, a specific pressing and then twisting motion may be used to separate the lid from the bottom portion to gain access to the interior of the container. The bottom portion may receive contents such as medication which may be securely stored and protected from children who might otherwise access an unprotected and unsecured container.

Figure 1:
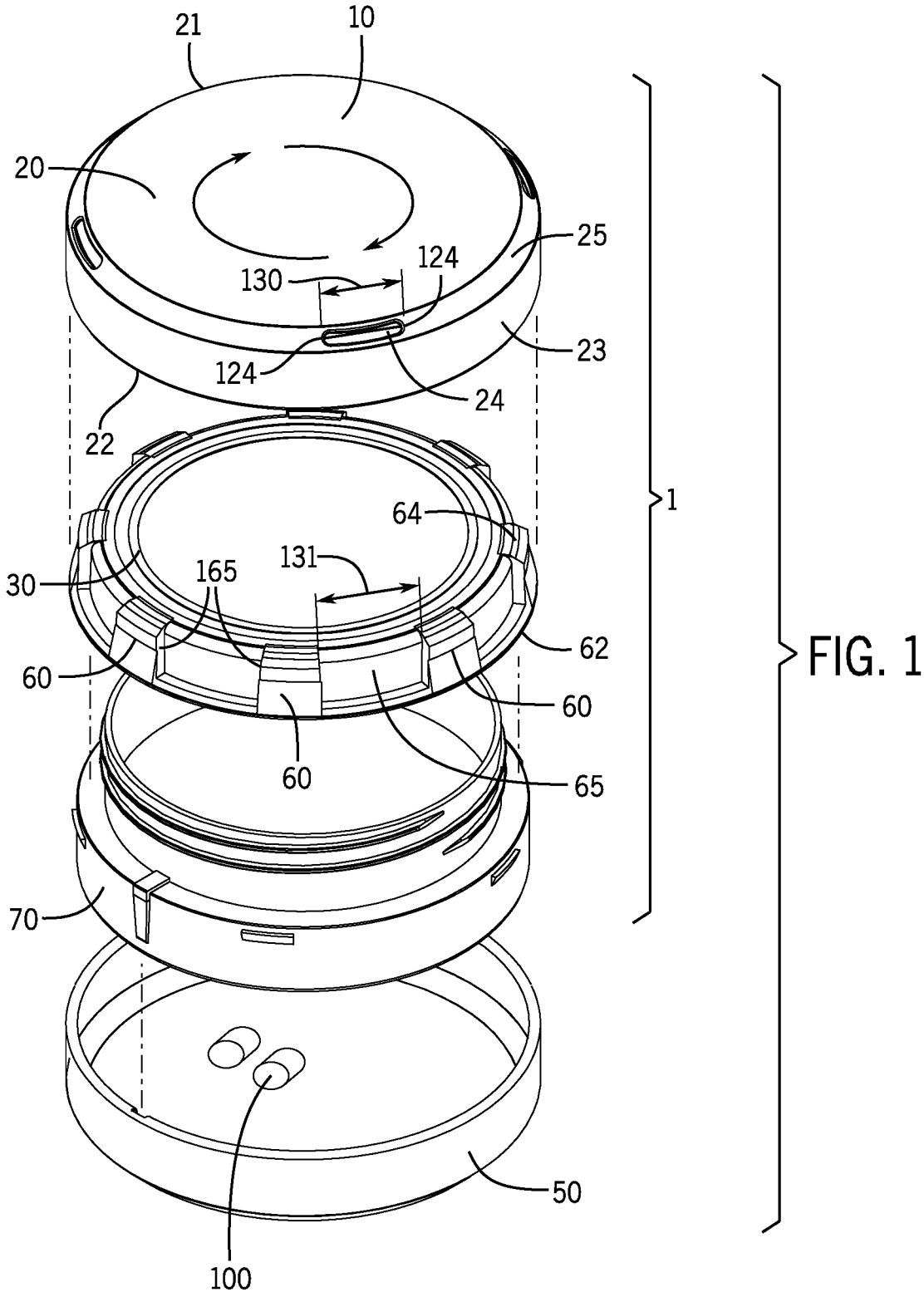
FIG. 1 illustrates an exploded view of the container.
Figure 2:
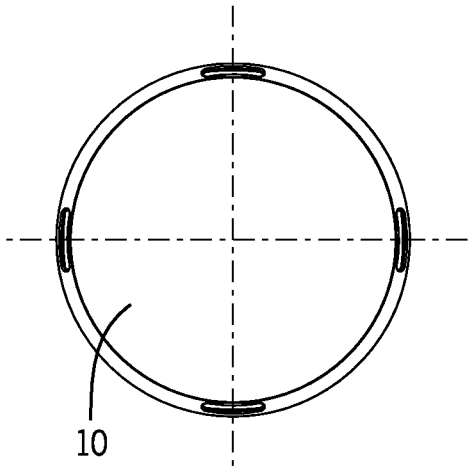
FIG. 2 illustrates a view of the top of the container.
Figure 3:
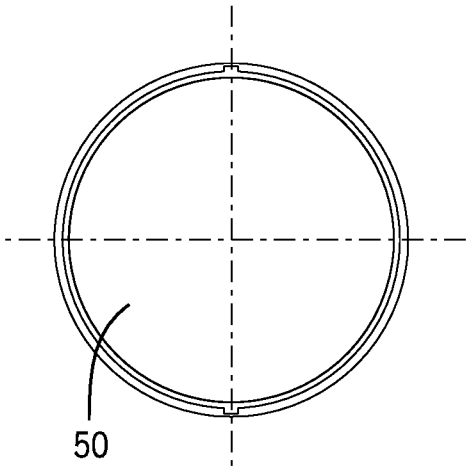
FIG. 3 illustrates a view of the bottom of the container.
Figure 4:
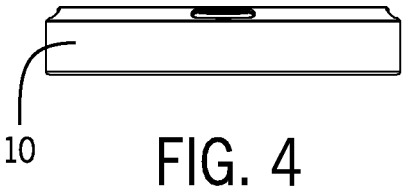
FIG. 4 illustrates a side view of the top of the container.
Figure 5:
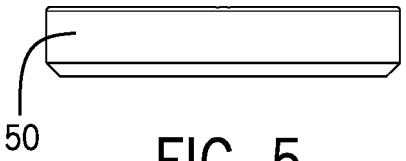
FIG. 5 illustrates a side view of the bottom of the container.
Figure 6:
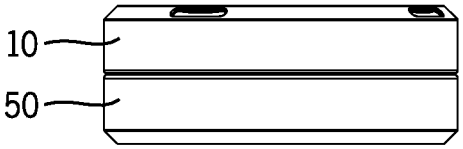
FIG. 6 illustrates a side view of the entire container.

Referring first to FIGS. 1 and 2, in an embodiment a secured container 1 is provided. The container 1 may have a lid (or "top") portion 10 and a bottom portion 50. The container 1 may be especially suitable for securing an item 100, such as medication, which can potentially be harmful to individuals, such as children, whom might otherwise gain access to the item (such as medicine) from a non-secure container. In an embodiment, the container 1 is largely made of a durable material, such as plastic and/or metal. In one embodiment, the container 1 is largely made of tin.

In an embodiment, the bottom portion 50 may have a removable interior liner 70. The liner 70 may have a bottom or may lack a bottom. In the embodiment with the bottom missing, the items 100 may rest directly on the bottom portion 50 (as shown in FIG. 1). In an embodiment, the container 1 may be air-tight when the lid 10 is secured to the bottom unit 50.

Figure 7:
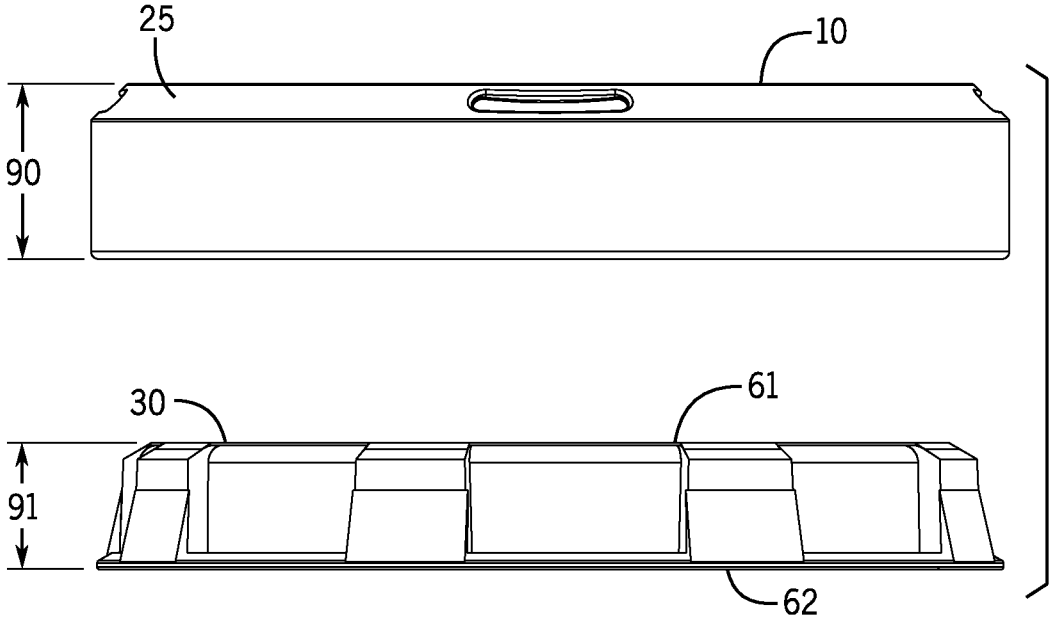
FIG. 7 illustrates an exploded side view of the lid and the bottom ring.
Figure 8:
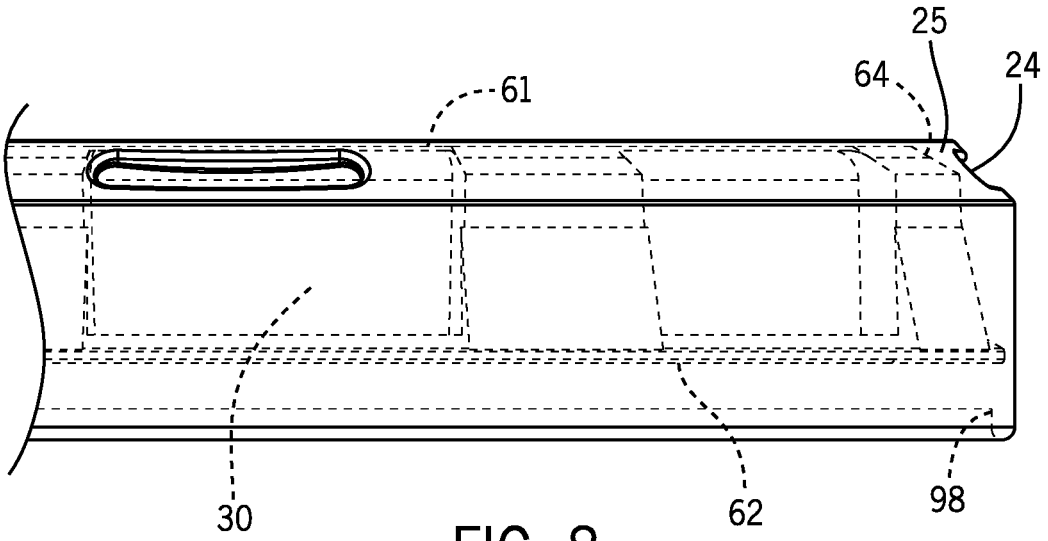
FIG. 8 illustrates a side view of the inward protrusion inserted into the indented space of the bottom ring.

In an embodiment, the lid portion 10 may be made of two different units which remain attached to each other. Specifically, the lid portion 10 may have an exterior cover 20 and a bottom ring 30. The exterior cover 20 may be rigid while the bottom ring 30 is flexible. The bottom ring 30 may have a top 61 (FIG. 7) and a bottom 62. The exterior cover 20 may be the portion of the lid that is most visible to the user. The exterior cover 20 may have a top 21, a bottom rim 22 and a generally cylindrical side 23. The top 21 of the lid 10 may have a plurality of extended inward protrusions 24 which may be, for example, located on a slanted portion 25 of the exterior cover 20 of the lid portion 10. In an embodiment, the protrusions 24 are located at or near the perimeter of the exterior cover 20 for easier twisting of the lid 10 when the inward protrusions 24 are properly aligned with the bottom ring 30 (as described below).

In an embodiment, the bottom ring 30 may have a plurality of extended protrusions 60 which created an indented space 65 between any two of the extended protrusions 60 of the bottom ring 30. When the lid portion 10 is pushed downward from the top 21 while being properly aligned with the bottom ring 30, the inward protrusions 24 of the exterior cover 20 will therein fall into the indented space 65 of the bottom ring 30. As a result, when the exterior cover 20 is rotated, the inward protrusions 24 become locked in the indented space 65 and, as a result, the twisting of the exterior cover 20 forces the inward protrusions 24 to contact the sides 165 of the extended protrusions 60 of the bottom ring 30 and therein allow a user to rotate the bottom ring 30 with respect to the bottom 50 of the container. As a result of the twisting, a user can separate the lid portion 10 from the bottom 50. If the inward protrusions 24 of the exterior cover 20 are not properly aligned with the indented spaces 65 of the bottom ring 30, the inward protrusions 24 will strike the top of the extended protrusions 60 of the bottom ring 30 (as opposed to falling into the indented spaces 65) and the exterior cover 20 will not rotate in unison with the bottom ring 30 when the exterior cover 20 is rotated and the lid 10 cannot be separated from the bottom 50. More specifically, when not properly aligned, the exterior cover 20 rotates independent from the bottom ring 30.

The exterior cover 20 may rotate three hundred and sixty degrees with respect to the bottom ring 30 when the inward protrusions 24 are not aligned with the indented spaces 65. Therefore, when a user manually twists the exterior cover 20, the exterior cover 20 rotates independent with the bottom ring 30. More specifically, when the lid portion 10 is not properly aligned, the inward protrusions 24 do not fall into the indented space 65 and a user cannot separate the bottom ring 30 from the bottom unit 50 and the lid 10 will remain locked to the bottom unit 50.

To release the lid 10 from the bottom portion 50, a user presses down on the top 21 of the exterior cover 20 of the lid 10 and therein compressing the bottom ring 30 of the lid 10. The inward protrusions 24, when properly aligned with the bottom ring 30, then fall into the indented spaces 65 (this may require a slight twisting by the user) so that the inward protrusions 24 lock into the indented space 65. The lid 10 may then be rotated and the container 1 opened.

The protrusions 24 may have a length 130 which is slightly less than a width 131 of the indented space 65 of the bottom ring 30 so that the protrusion 24 may be slightly pushed down into the intended space 65. The side 124 of the protrusion 24 of the lid 10 may catch the interior side 165 of the indented space 65 so that the lid 10, when twisted, catches the extended protrusions 60 of the bottom ring 30 and may therefore rotate the bottom ring 30.

Because of the slanted nature of the top 64 of the extended protrusion 60 of the bottom ring 30, if the correct and proper pressure is not applied to the top 21 of the exterior cover 20 then the side 124 of the inward protrusion 24 cannot catch the interior side 165 of the extended protrusion 60 of the bottom ring 30 to rotate the bottom ring 30 in unison with the exterior cover 20. In particular, if only a light downward pressure is applied to the top 21 of the exterior cover 20 (for example, from a child) the slanted nature of the top 64 of the extended protrusions 60 will not stop the rotation of the exterior cover 20 independent of the bottom ring 30 since the slanted nature of the top 64 of the protrusions 60 cannot catch the inward protrusions 24 (which have curved edges 124) of the exterior cover 20. However, when proper pressure is applied, the bottom ring 30 gets slightly compressed so that the inward extended protrusion 24 may properly move into the indented space 65 when aligned. In one embodiment, the slanted portion 64 of the top of the protrusions 60 is identical to the angle of the slanted portion 25 of the exterior cover 20 so as to allow the lid 10 to proper lock when aligned.

In an embodiment, the exterior cover 20 of the lid 10 may have a height 90 which is slightly larger than a height 91 of the bottom ring 30 so that the bottom ring 30 may fit and be located under the exterior cover 20 of the lid 10.

A curled, inward-rolled lip 98 may prevent the bottom ring 30 from falling out the underside of the exterior 20 of the lid 10. The curled, inward-rolled lip 98 may be smooth and may form an air-tight seal with the container 1 when sealed. This may increase safety, reduce air and contaminants from contacting the contents 100 of the container 1 and may also increase the appearance of the container 1. Finally, in one embodiment, the lid 10 and the bottom portion 50 may be slightly magnetically attracted to each other so as to form a greater seal.

A threaded member (not shown) of the underside of the bottom ring 30 may correspondingly mate with a corresponding threaded member of the bottom portion 50 of the container 1 so that the lid 10 and the bottom 50 may be temporarily secured together.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A container comprising:

a top unit having an exterior cover and a bottom ring;

a bottom unit wherein the top unit is temporarily and selectively secured to the bottom unit;

wherein the exterior cover of the top unit has a plurality of inward protrusions;

wherein the bottom ring of the top unit has indented spaces formed between extended protrusions of the bottom ring; and wherein the top unit may only be separated from the bottom unit when the inward protrusions of the exterior cover are located within the indented spaces of the bottom ring and the top unit is twisted.

2. The container of claim 1 wherein the exterior cover of the top unit may independently rotate three hundred and sixty degrees with respect to the bottom ring of the top unit when the inward protrusions of the exterior ring are not located within the indented spaces of the bottom ring.

3. The container of claim 1 wherein the top unit and the bottom unit are magnetic and are attracted to each other.

4. The container of claim 1 wherein the exterior cover of the top unit is rigid and wherein the bottom ring of the top unit is flexible.

5. The container of claim 1 wherein the inward protrusions of the exterior cover have sides and wherein the sides are curved.

6. The container of claim 1 wherein the extended protrusions of the bottom ring have a top and wherein the top is slanted.

7. The container of claim 1 wherein a perimeter of the exterior cover of the top unit is slanted.

8. The container of claim 1 wherein the bottom unit has a liner lacking a bottom.

9. The container of claim 1 wherein the bottom unit has a liner having a bottom.

10. The container of claim 6 wherein the slanted top of the extended protrusions of the bottom ring has the same angle as a slanted perimeter of the exterior cover.

11. The container of claim 1 wherein the exterior cover has a slanted perimeter.

12. The container of claim 1 wherein the container is air tight when the top unit is sealed to the bottom unit.

13. The container of claim 1 wherein the inward protrusions of the exterior cover are located on a slanted perimeter of the exterior cover.

* * * * *